US005634838A

United States Patent [19]

Egami et al.

[11] Patent Number: 5,634,838

[45] Date of Patent: Jun. 3, 1997

[54] COLOR SELECTING ELECTRODE FOR COLOR-PICTURE TUBE AND MANUFACTURING METHOD THEREOF

[75] Inventors: Norihiko Egami, Hirakata; Tatsuhiro Otsubo, Miki; Manabu Kakino, Uji; Masaru Nagaike; Takashi Ichiyanagi, both of Hirakata, all of Japan

[73] Assignee: Matsushita Electric Industrial Co., Ltd., Osaka-fu, Japan

[21] Appl. No.: 564,731

[22] Filed: Nov. 29, 1995

[30] Foreign Application Priority Data

Nov. 30, 1994 [JP] Japan ..... 6-296944

[51] Int. Cl.[6] ..... H01J 29/07

[52] U.S. Cl. ..... 445/30; 445/37

[58] Field of Search ..... 445/30, 37; 313/407

[56] References Cited

U.S. PATENT DOCUMENTS 3,715,906 2/1973 Roper ..... 445/30 X 4,333,034 6/1982 Ohgoshi et al. ..... 313/407

5,214,349 5/1993 Sakata et al. ..... 313/407

FOREIGN PATENT DOCUMENTS 48344 2/1989 Japan ..... 313/407

187132 8/1991 Japan ..... 313/407

*Primary Examiner*—Kenneth J. Ramsey

*Attorney, Agent, or Firm*—Wenderoth, Lind & Ponack

[57] ABSTRACT

A color selecting electrode for a color-picture tube, includes a rectangular frame-shaped frame having a pair of mutually-opposite long sides and a pair of mutually-opposite short sides, and a mask plate which is stretchedly supported on top surfaces of the frame while receiving a resilient spring force exerted from the frame, the long sides having a greater section modulus and a greater rigidity than the short sides. A method of manufacturing the color selecting electrode includes the step of welding, to the frame pressed inward by an equally-distributed force applied to the pair of long sides and the pair of short sides, the mask plate of which four sides are stretched outward by a distributed force which approximately counterbalances the equally distributed force.

3 Claims, 11 Drawing Sheets

COLOR SELECTING ELECTRODE FOR COLOR-PICTURE TUBE AND MANUFACTURING METHOD THEREOF

BACKGROUND OF THE INVENTION

The present invention relates to a color selecting electrode for a color-picture tube for use in television receivers, computer terminal displays and the like, and a manufacturing method thereof.

In general, a color selecting electrode of a color-picture tube is comprised of a mask plate 1 made of a metal and a rectangular frame-shaped frame 2 made of a metal for stretchingly supporting the mask plate 1 as shown in FIG. 13. The mask plate 1 has a lot of slots 3 for letting electron beams pass therethrough, and four support end portions 1*a* through 1*d* of the mask plate 1 are welded to top surfaces of a pair of mutually-opposite long sides 4 and 5 and a pair of mutually-opposite short sides 6 and 7 of the frame 2.

In the above-mentioned welding process, the pair of long sides 4 and 5 and the pair of short sides 6 and 7 of the frame 2 are each pressed inward to be bent in a manner as shown in FIG. 14A. Then, while maintaining this state of bending, the support end portions 1*a* through 1*d* of the mask plate 1 are welded to the top surfaces of the four sides 4 through 7 of the frame 2 in a manner as shown in FIG. 14B, and thereafter the above-mentioned pressure is released in a manner as shown in FIG. 14C. As a result, a resilient force of the four sides 4 through 7 of the frame 2 exert a tension force to the mask plate 1 thereby allowing the mask plate 1 to be stretched with a high degree of flatness.

The tension force required for making the mask plate maintain a specified degree of flatness is of a great value of as much or about 10 $kgf/mm^2$. Then, in order to generate such a great tension force, the mask plate is welded to the frame with each side of the frame bent inward, so that a resilient spring force is given to each of the sides. Then, the mask plate comes to have an elevated temperature upon collision of electron beams against the mask plate to consequently expand, with which the sides of the frame are deformed in a direction in which the degree of bending reduces. In the above-mentioned case, the mask plate extends more in the direction of the long sides than in the direction of the short sides. In contrast to the above, since the two short sides of the frame have a greater rigidity than the two long sides, the amount of displacement in the two short sides becomes much smaller than the amount of displacement in the two long sides, and the tension in the direction of the long sides becomes smaller than the tension in the direction of the short sides. Thus the tension in the direction of the long sides and the tension in the direction of the short sides of the mask plate are unbalanced at an elevated temperature, and this causes a problem that it is difficult to maintain the flatness of the mask plate at an appropriate value.

Furthermore, when a frame having a great plate thickness is used so as to increase the aforementioned rigidity, not only an increased weight results but also a support mechanism for supporting the color selecting electrode inside the color-picture tube is dimensionally increased, resulting in an increased totaled weight of the color-picture tube.

SUMMARY OF THE INVENTION

Accordingly, it is an object of the present invention to provide a color selecting electrode capable of stably stretching the mask plate with a high degree of flatness on the frame without excessively increasing the weight of the frame and the support mechanism thereof, and to provide a manufacturing method thereof.

In accomplishing these and other objects, according to one aspect of the present invention, there is provided a color selecting electrode for a color-picture tube, comprising:

a rectangular frame-shaped frame having a pair of mutually-opposite long sides and a pair of mutually-opposite short sides; and a mask plate which is stretchedly supported on top surfaces of the frame while receiving a resilient spring force exerted from the frame, the long sides having a greater section modulus and a greater rigidity than those of the short sides.

According to another aspect of the present invention, there is provided a method of manufacturing a color selecting electrode for a color-picture tube comprising: a rectangular frame-shaped frame having a pair of mutually-opposite long sides and a pair of mutually-opposite short sides; and a mask plate welded to top surfaces of the frame, the long sides having a greater section modulus and a greater rigidity than those of the short sides, the method comprising the step of:

welding, to the frame pressed inward by an equally-distributed weight (or force) applied to the pair of long sides and the pair of short sides, a mask plate of which four sides are stretched outward by a distributed force which approximately counterbalances the equally distributed force.

BRIEF DESCRIPTION OF THE DRAWINGS

These and other aspects and features of the present invention will become clear from the following description taken in conjunction with the preferred embodiments thereof with reference to the accompanying drawings, in which.

DETAILED DESCRIPTION OF THE PREFERRED EMBODIMENTS

Figure 1:
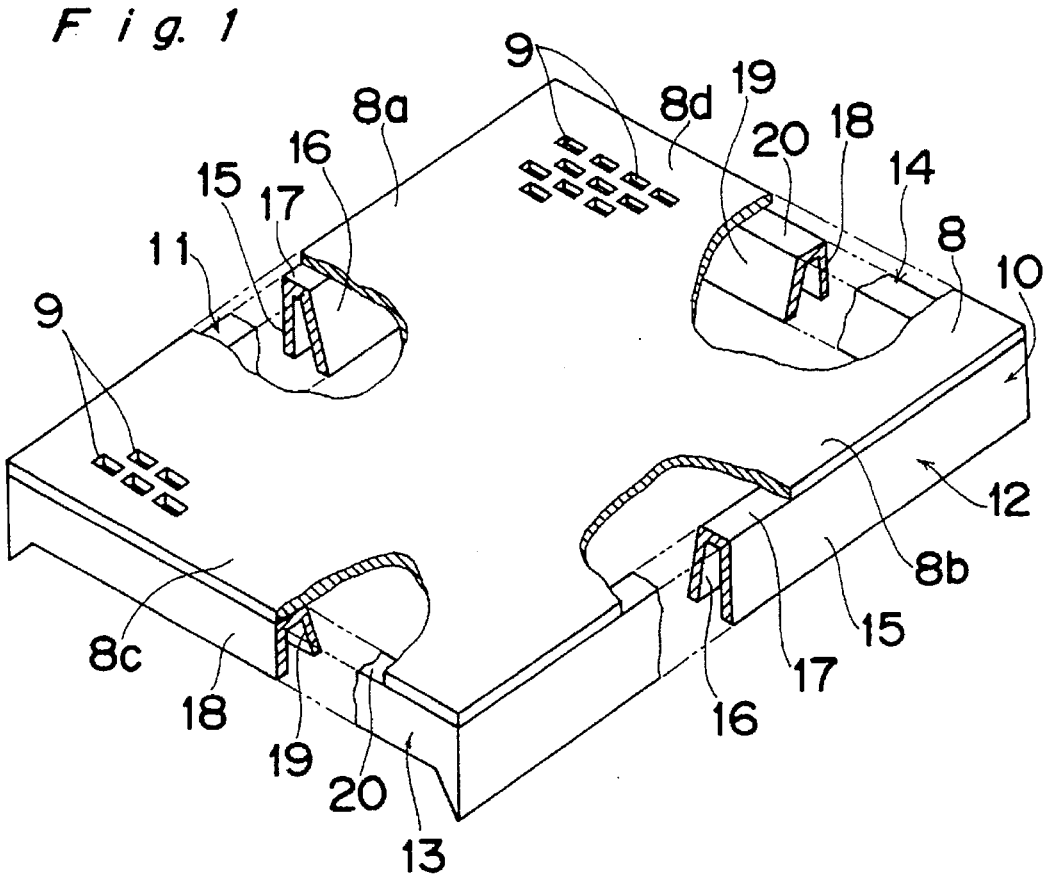
FIG. 1 is a perspective view of a color selecting electrode for a color-picture tube shown with parts thereof removed, according to an embodiment of the present invention.

Before the description of the present invention proceeds, it is to be noted that like parts are designated by like reference numerals throughout the accompanying drawings.

Embodiments of the present invention will be described below with reference to the accompanying drawings.

Figure 2:
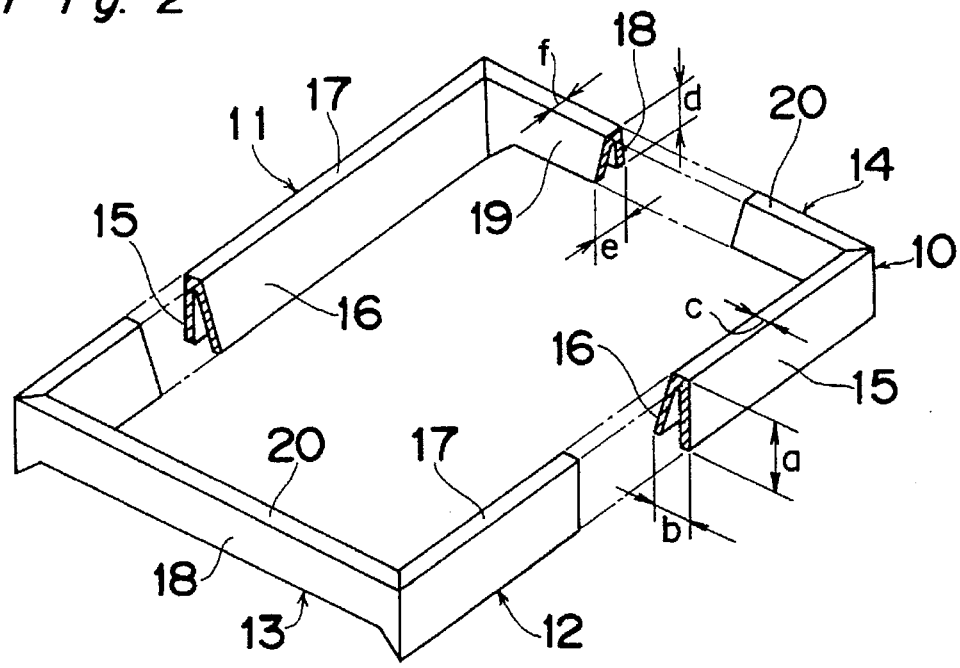
FIG. 2 is a perspective view of a frame shown with parts thereof removed according to the embodiment of the present invention.

A mask plate 8 as shown in FIG. 1 has a rectangular configuration, and includes a plurality of slots 9 in its plate surface surrounded by support end portions 8*a* and 8*b* of its two long sides and support end portions 8*c* and 8*d* of its two short sides. On the other hand, a frame 10 for stretchingly supporting the mask plate 8 has a rectangular frame-shaped configuration as shown in FIG. 2, in which a pair of mutually-opposite long sides 11 and 12 and a pair of mutually-opposite short sides 13 and 14 are connected to each other by welding or brazing, and an aspect ratio of the frame 10 is 3:4. It is to be noted that the welding is effected inside and outside four corners of the frame 10.

The pair of long sides 11 and 12 are composed of a metal plate material made principally of iron having a plate thickness of 1.8 mm, and each of the long sides 11, 12 is formed sectionally in an inverted V-shaped configuration in which its top surface 17 is placed between its outer vertical surface 15 and its inner inclined surface 16. For example, each of the long sides has a height "a" of 37.5 mm, a bottom width "b" of 28.5 mm, and a top surface width "c" of 7 mm. On the other hand, the pair of short sides 13 and 14 are composed of a metal plate material made principally of iron having a plate thickness of 1.8 mm, and each of the short sides 13, 14 is formed sectionally in an inverted V-shaped configuration in which its top surface 20 is placed between its outer vertical surface 18 and its inner inclined surface 19. For example, each of the short sides has a height "d" of 20.0 mm, a bottom width "e" of 12.0 mm, and a top surface width "f" of 7 mm. The pair of long sides 11 and 12 have a greater section modulus and a greater rigidity than the pair of short sides 13 and 14.

Figure 3:
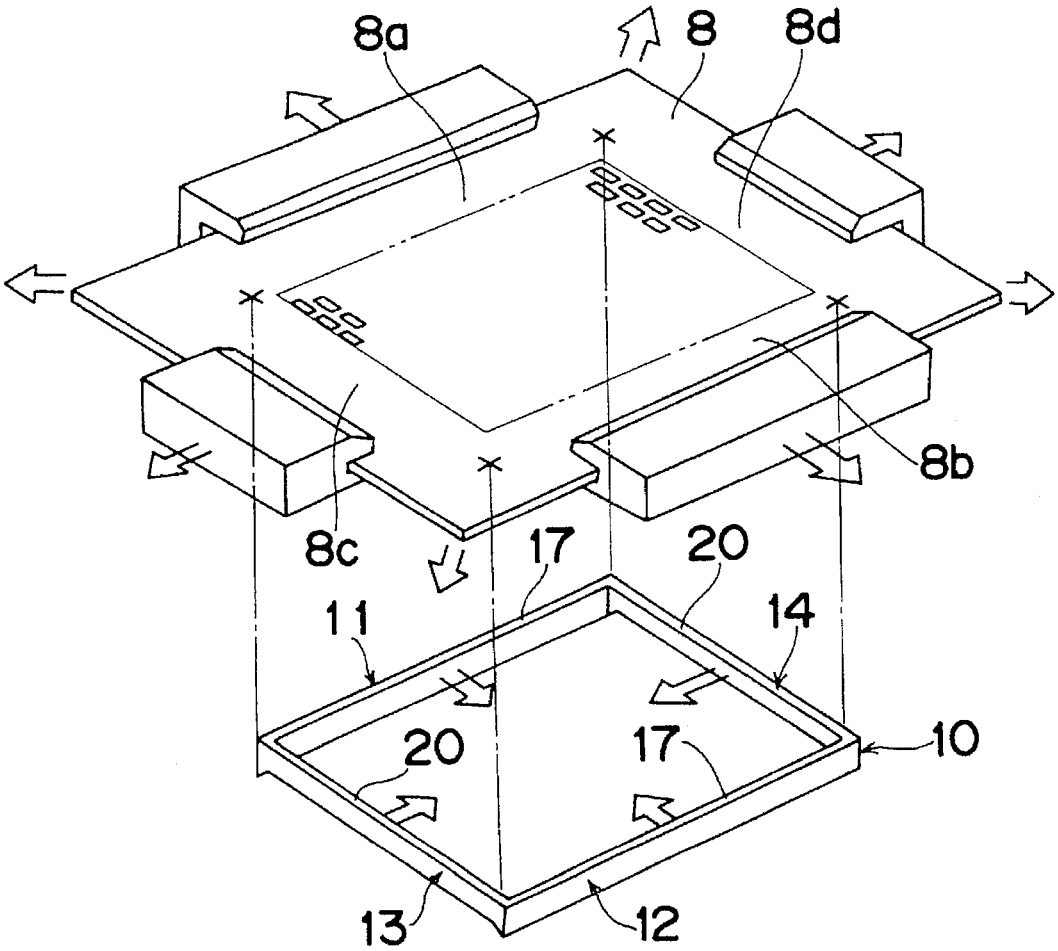
FIG. 3 is an explanatory view of a welding process for a mask plate and a frame according to the embodiment of the present invention.

When welding the support end portions 8*a* through 8*d* of the four sides of the mask plate 8 onto the top surfaces 17 and 20, the pair of long sides 11 and 12 and the pair of short sides 13 and 14 of the frame 10 are pressed inward each with an equally-distributed weight (or force) of 10 kgf/mm$^2$ in a manner as shown in FIG. 3. Then, while stretching outward the four sides of the mask plate 8 along the plate surface with a distributed force which counterbalances the pressure, the support end portions 8*a* through 8*d* of the four sides of the mask plate 8 are welded to the top surfaces 17 and 20 of the four sides of the frame 10, and thereafter the pressing force and the tension force are released.

Figure 4:
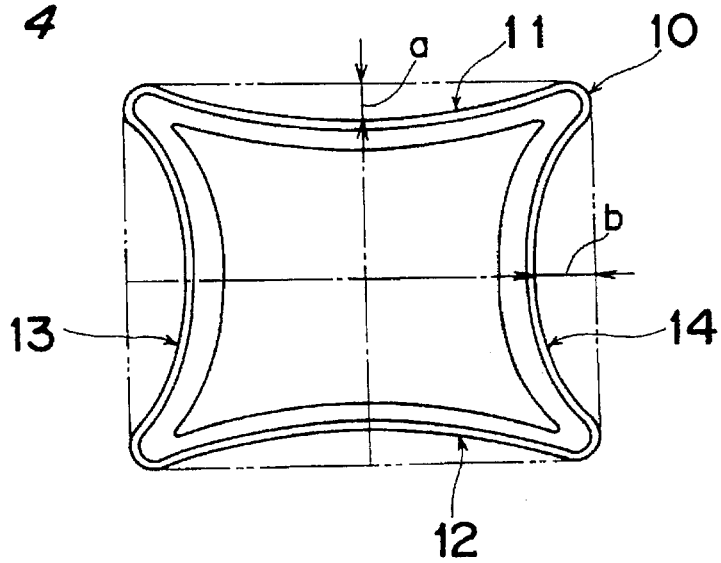
FIG. 4 is an explanatory view of the amount of forced displacement when a frame of the embodiment of the present invention is pressed.

In the present embodiment, rigidities relevant to bending and torsion of the pair of long sides 11 and 12 of the frame 10 and rigidities relevant to bending and torsion of the pair of short sides 13 and 14 of the frame 10 are set at a ratio of about 4:3. Therefore, the frame 10 to which is applied the equally-distributed weight bends with the dimensions "a" and "b" at a ratio of approximately 3:4 in a manner as exaggeratively shown in FIG. 4. Then, a resilient spring force generated in the frame 10 applies a tension force to the mask plate 8 welded to the four sides of the frame 10 uniformly throughout the plate surface. As a result, the mask plate 8 is stably stretched while maintaining high flatness.

Figure 5A:
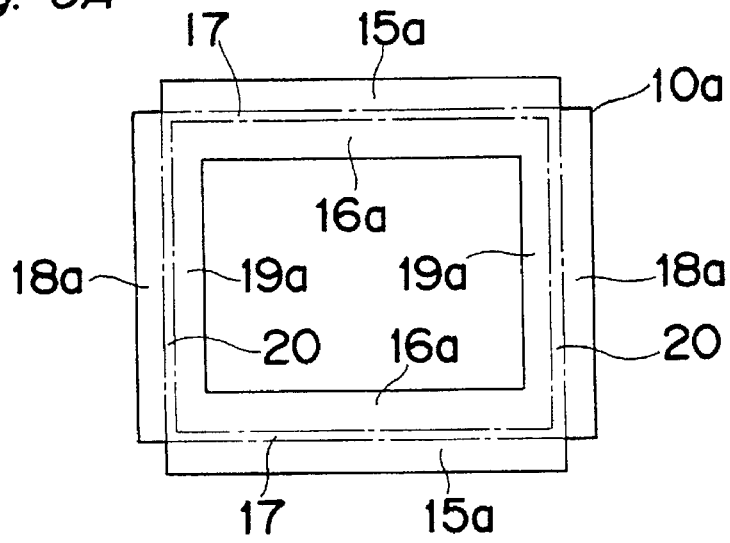
FIGS. 5A, 5B, and 5C are views showing a manufacturing process of a frame according to another embodiment of the present invention.
Figure 5B:
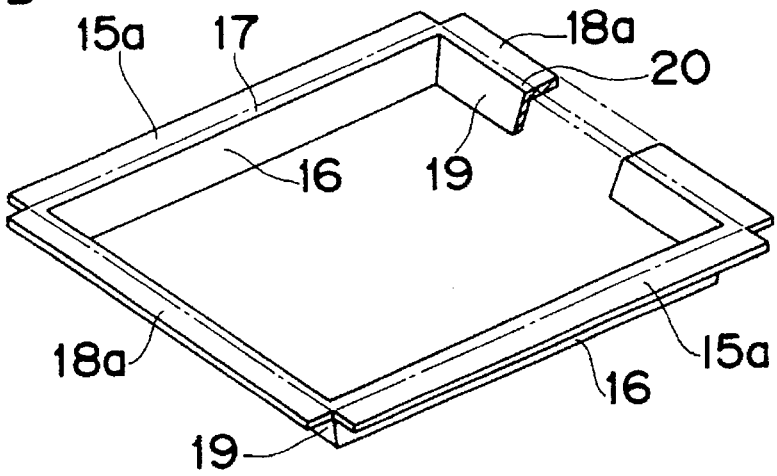
Figure 5C:
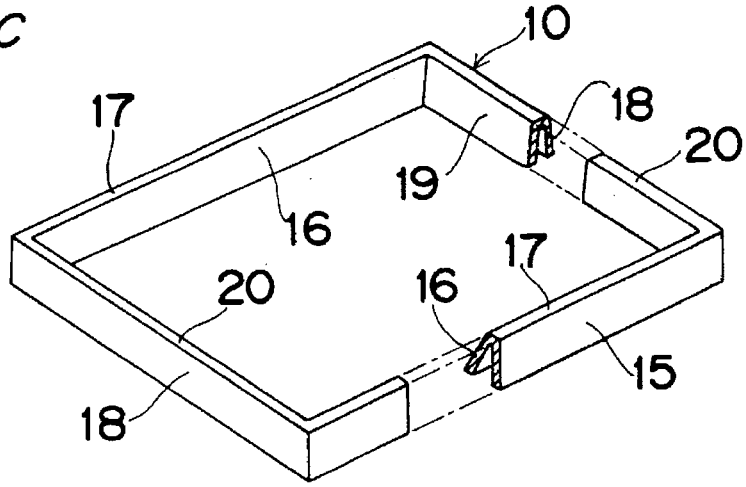

A frame according to another embodiment of the present invention is shown in FIGS. 5A, 5B, and 5C. In the present case, inner areas 16*a* and 19*a* of a metal plate 10*a* cut out in a flat shape as shown in FIG. 5A are subjected to a drawing process, so that inner inclined surfaces 16 of the two long sides and inner inclined surfaces 19 of the two short sides are formed in a manner as shown in FIG. 5B. Then, outer areas 15*a* and 18*a* are subjected to a bending press working process, so that outer vertical surfaces 15 of the two long sides and outer vertical surfaces 18 of the two short sides are formed in a manner as shown in FIG. 5C. Then, adjacent portions at the four corners of the outer vertical surfaces 15 and 18 are welded together.

When the frame 10 is thus formed, though a reduced use efficiency of the material results, there is obviated the needs for mutually connecting the four sides, thereby allowing both improved manufacturing accuracy and improved manufacturing efficiency to be achieved.

Figure 6:
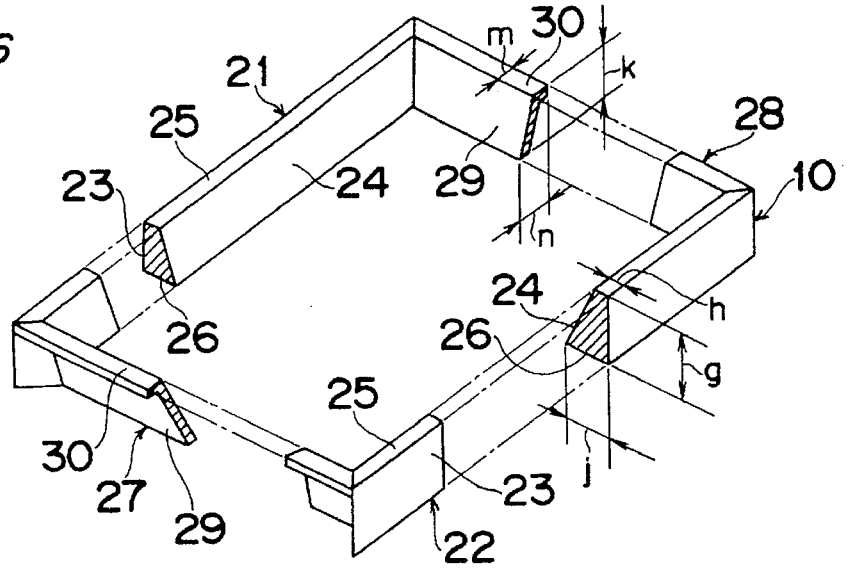
FIG. 6 is a perspective view of a frame shown with parts thereof removed, according to another embodiment of the present invention.

Another embodiment of the frame 10 is shown in FIG. 6. In the present case, a pair of long sides 21 and 22 are each formed sectionally in a trapezoidal configuration having an outer vertical surface 23, an inner inclined surface 24, a top surface 25, and a bottom surface 26 which is wider than the top surface 25. For example, each of the long sides has a height "g" of 21 mm, a top surface width "h" of 7 mm, and a bottom surface width "j" of 18 mm. Furthermore, a pair of short sides 27 and 28 are each formed of a plate member sectionally in a λ-shaped configuration having an inner inclined surface 29 and a top surface 30. For example, each of the short sides has a plate thickness of 3 mm, a height "k" of 21 mm, a top surface width "m" of 7 mm, and a total width "n" of 18 mm.

With the above-mentioned construction, though the frame has a relatively low height, rigidities relevant to bending and torsion of the pair of long sides 21 and 22 and rigidities relevant to bending and torsion of the pair of short sides 27 and 28 can be set at a ratio of about 4:3 in the same manner as in the aforementioned frame.

The aforementioned external forces of pressing and tension differ depending on the material, plate thickness, strength, and so forth of the frame 10. A practical numerical range is 6 kgf/mm$^2$ to 20 kgf/mm$^2$. When the pressing force and the tension force are not approximately balanced, the intended purpose cannot be satisfactorily achieved. Furthermore, each of the two short sides 27 and 28 may be formed sectionally in an inverted V-shaped configuration.

Figure 7A:
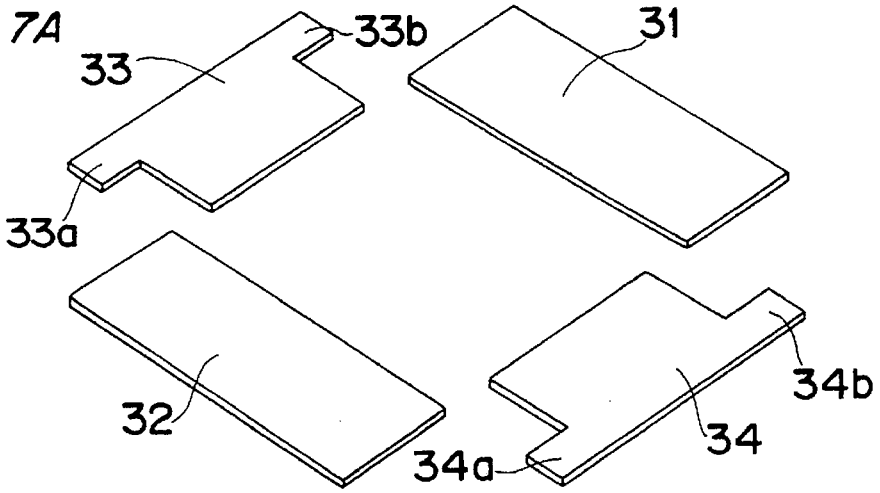
FIGS. 7A and 7B are views showing a manufacturing process of a frame according to another embodiment of the present invention.
Figure 7B:
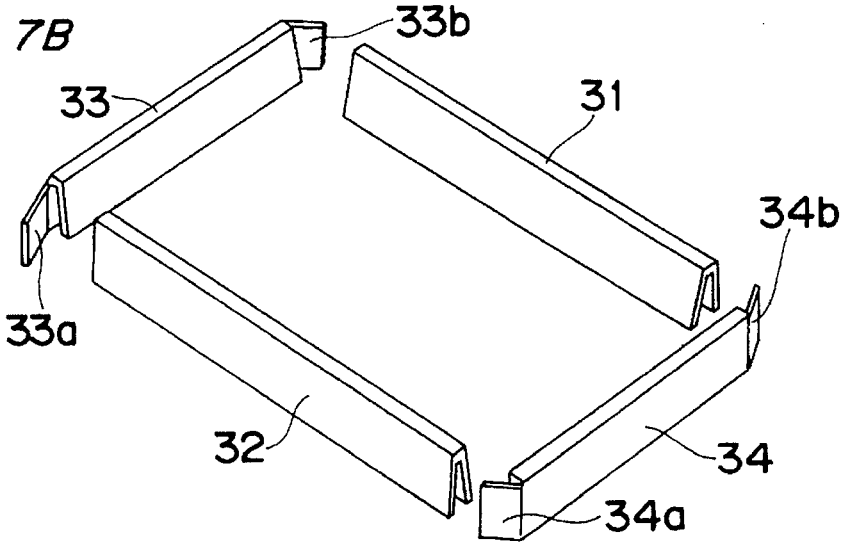

A frame according to another embodiment is shown in FIGS. 7A and 7B. In the present case, a pair of long side metal strips 31 and 32 and a pair of short side metal strips 33 and 34, cut out in flat shapes as shown in FIG. 7A, are subjected to press working processes, so that each of them is bent sectionally in an inverted V-shaped configuration as shown in FIG. 7B. Then, projecting tab portions 33*a*, 33*b*, 34*a*, and 34*b* projecting from both end portions of the pair of short side use metal strips 33 and 34 are welded to both end portions of the pair of long side metal strips 31 and 32.

Figure 8A:
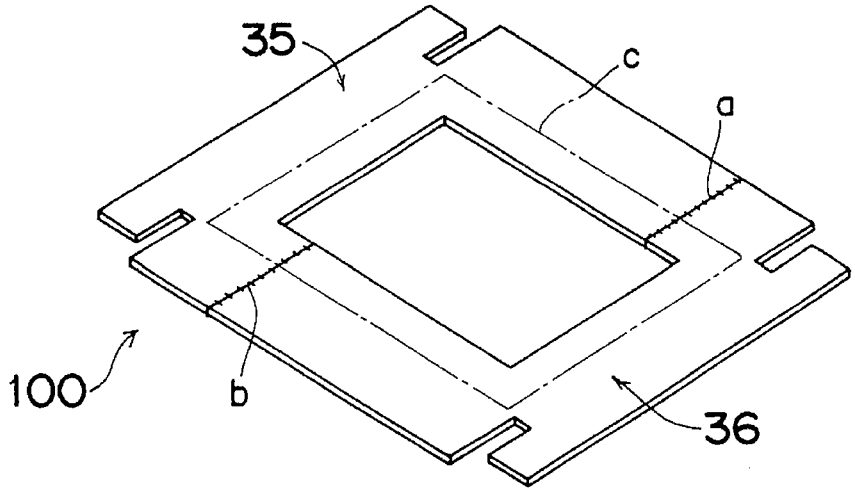
FIGS. 8A, 8B, and 8C are views showing a manufacturing process of a frame according to another embodiment of the present invention.
Figure 8B:
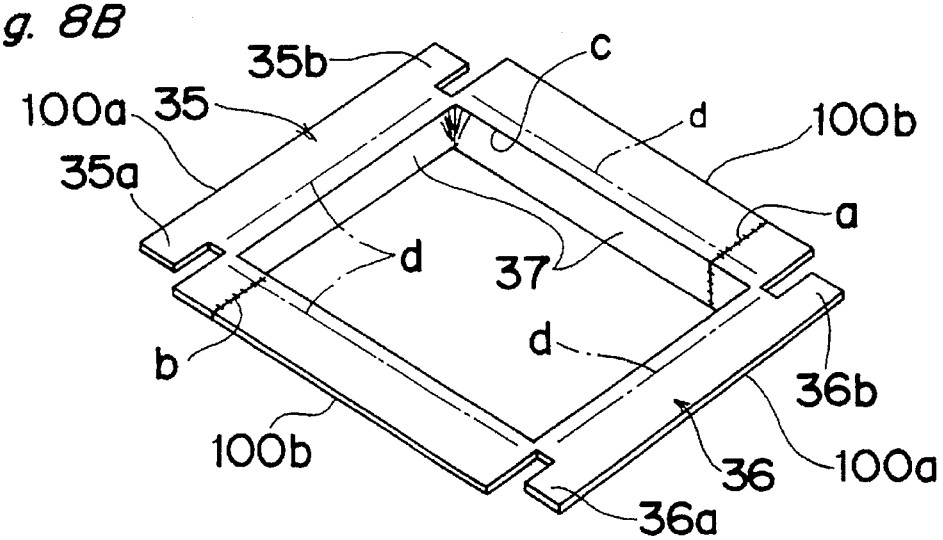
Figure 8C:
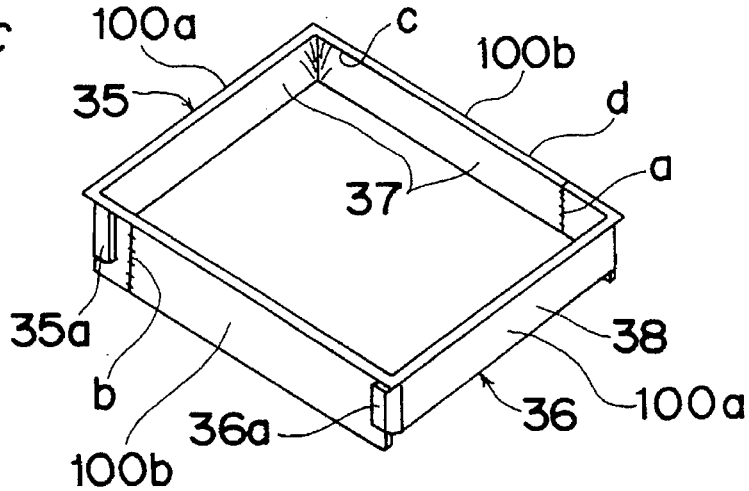

Furthermore, in a frame according to another embodiment as shown in FIGS. 8A, 8B, and 8C, an integrated plate member 100 obtained by welding together two L-shaped metal plates 35 and 36 at abutting positions "a" and "b" of the two plates 35, 36 as shown in FIG. 8A is subjected to press working process, and inner portions inside a frame line "c" are bent to form inner inclined surfaces 37 as shown in FIG. 8B. Then, outer portions outside a frame line "d" are bent to form outer vertical surfaces 38 as shown in FIG. 8C, and projecting tab portions 35*a*, 35*b*, 36*a*, and 36*b* projecting from both end portions of the two short sides 100*a*, 100*a* are welded to both end portions of the two long sides 100*b*, 100*b*.

Figure 9:
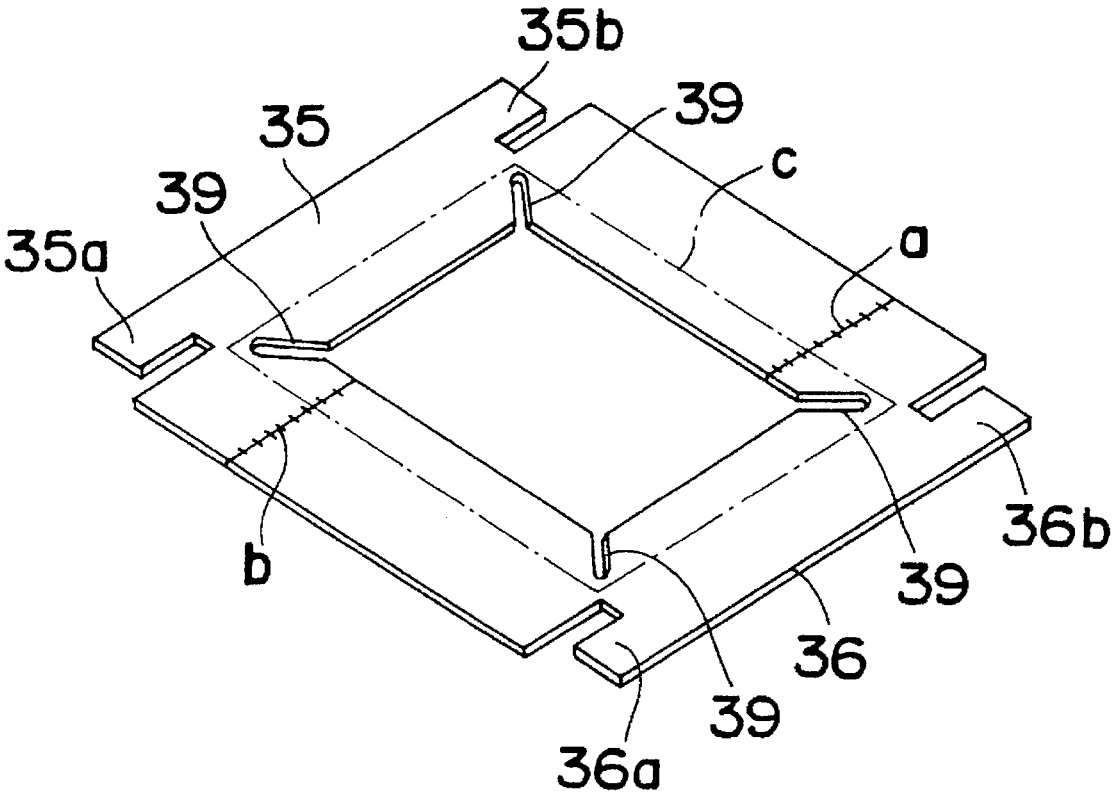
FIG. 9 is a perspective view of a frame prior to a bending process therefore according to another embodiment of the present invention.

In an embodiment as shown in FIG. 9, a slit 39 is formed at each of four inner corners of the integrated plate member 100 shown in FIG. 8A, so that the inner portions inside the frame line "c" can be bent with high processing accuracy.

Figure 10A:
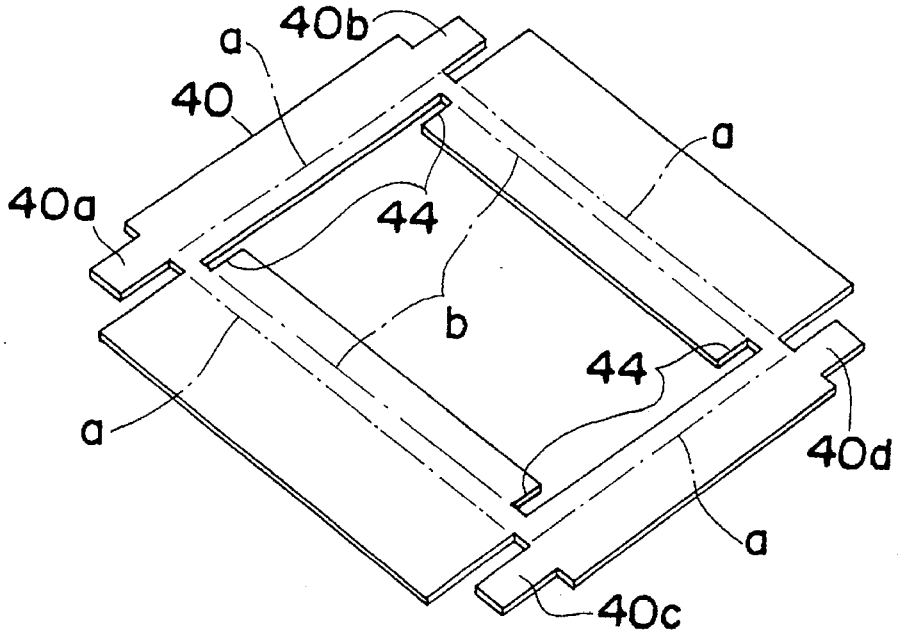
FIGS. 10A, 10B, and 10C are views showing a manufacturing process of a frame according to another embodiment of the present invention.
Figure 10B:
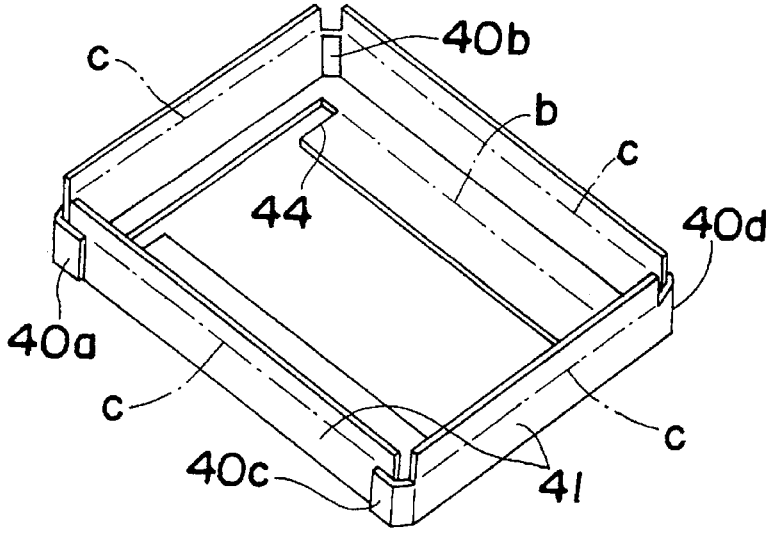
Figure 10C:
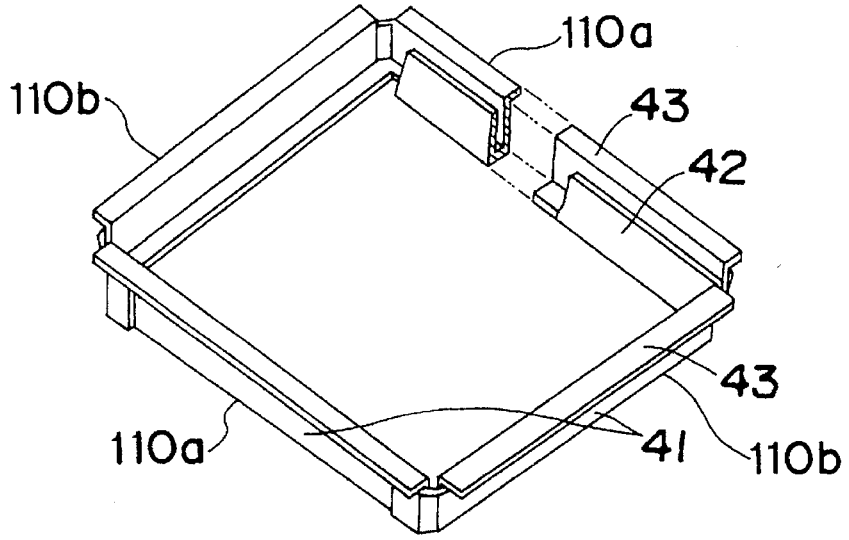

In an embodiment as shown in FIGS. 10A, 10B, and 10C, an outer portion outside each frame line "a" of a metal plate 40 cut out in a flat shape as shown in FIG. 10A is bent perpendicularly, and projecting tab portions 40*a* through 40*d* at four corners are bent and welded in a manner as shown in FIG. 10B to form outer vertical surfaces 41. Then, an inner portion inside each frame line "b" is folded back to form an inner inclined surface 42, and an outer portion outside each frame line "c" is bent perpendicularly to form a top surface 43. In the present case, the long side 110*a* has a δ-shaped sectional configuration, while the short side 110*b* has a Z-shaped sectional configuration. However, the short side 110*b* can be made to have a δ-shaped sectional configuration. Furthermore, a slit 44 is formed at each of four inner corners, and therefore the frame plate can be bent with high processing accuracy.

In the frame of each embodiment, the pair of long sides has a greater section modulus and a greater rigidity than the pair of short sides.

Figure 11A:
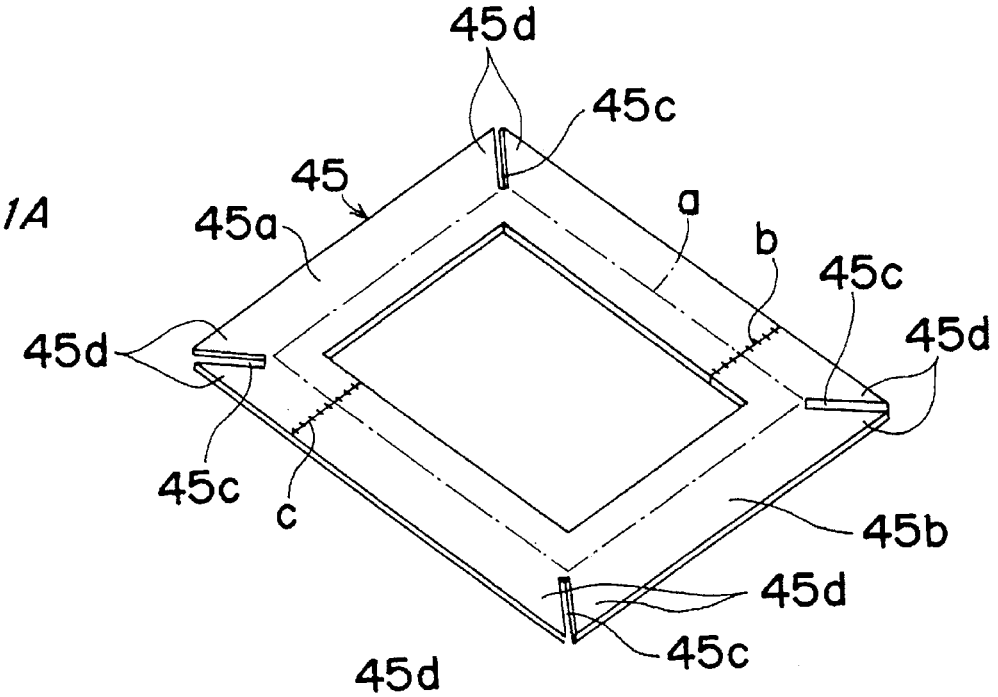
FIGS. 11A and 11B are views showing a manufacturing process of a frame according to another embodiment of the present invention.
Figure 11B:
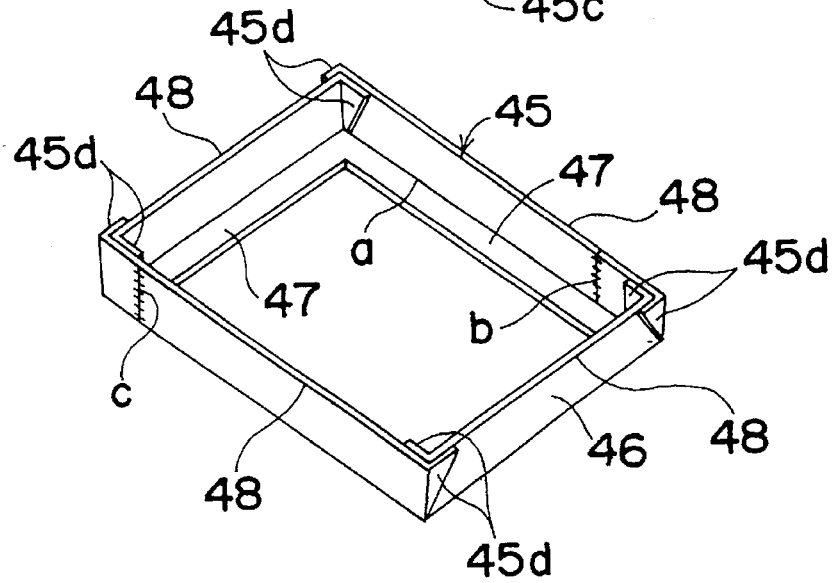

In an embodiment shown in FIGS. 11A and 11B, an integrated plate member 45 is obtained by welding together two L-shaped metal plates 45*a* and 45*b* at abutting positions "b" and "c" of the two plates 45*a*, 45*b* as shown in FIG. 11A. An outer portion outside a frame line "a" of the integrated plate member 45 formed in a flat shape as shown in FIG. 11A is bent perpendicularly, and a slit 45*c* is formed at each of four outer corners to overlap end portions 45*d* with each other at each corner of the integrated plate member 45, so that four corners of the plate member 45 are braced together in a manner as shown in FIG. 11B to form vertical surfaces 46, bottom surfaces 47, and top surfaces 48. When the width of the bottom surface 47 is made greater on the long sides than on the short sides, the long sides have a greater section modulus and a greater rigidity than those of the short sides.

Figure 12A:
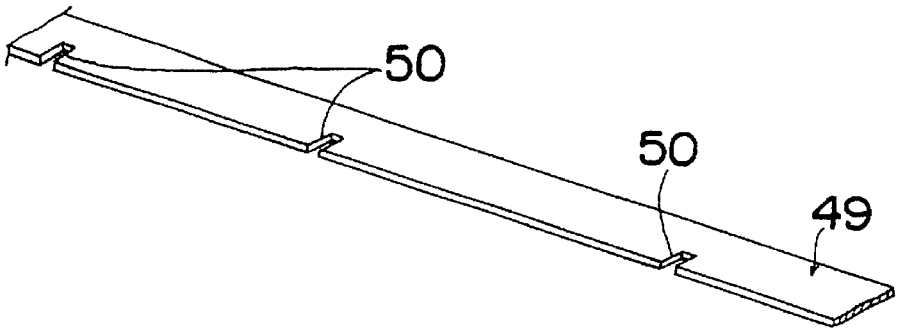
FIGS. 12A, 12B, 12C, and 12D are views showing a manufacturing process of a frame according to another embodiment of the present invention.
Figure 12B:
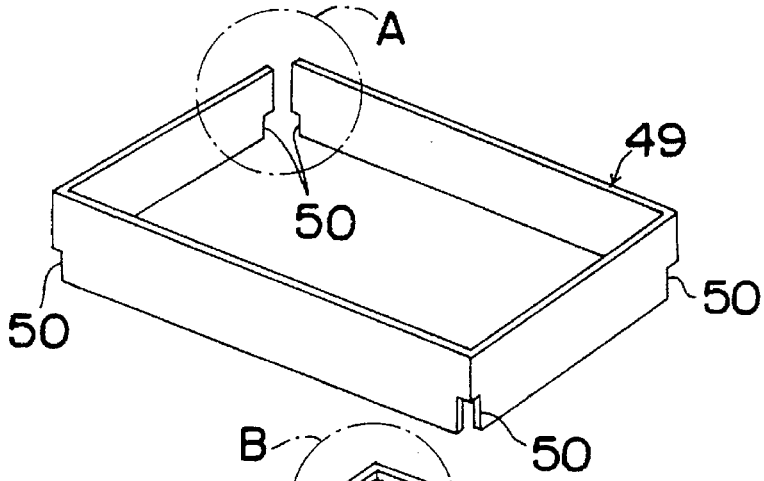
Figure 12C:
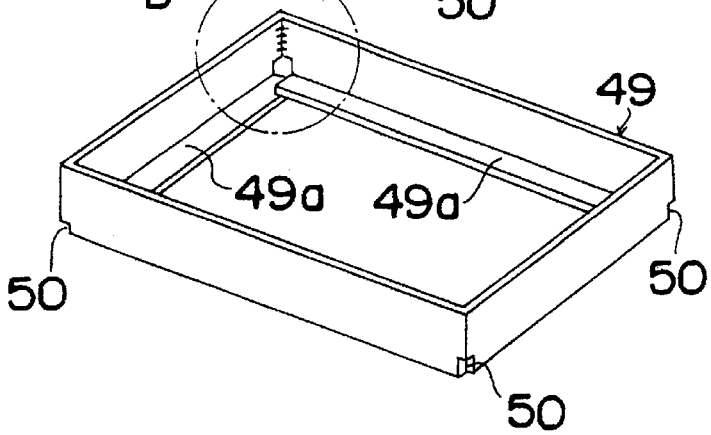
Figure 12D:
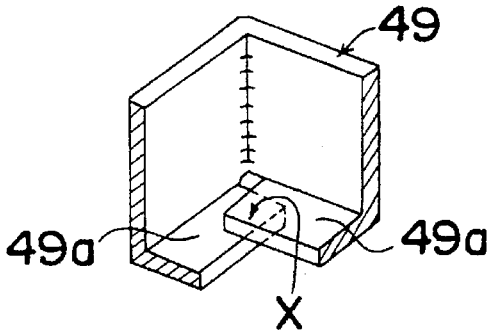
Figure 13:
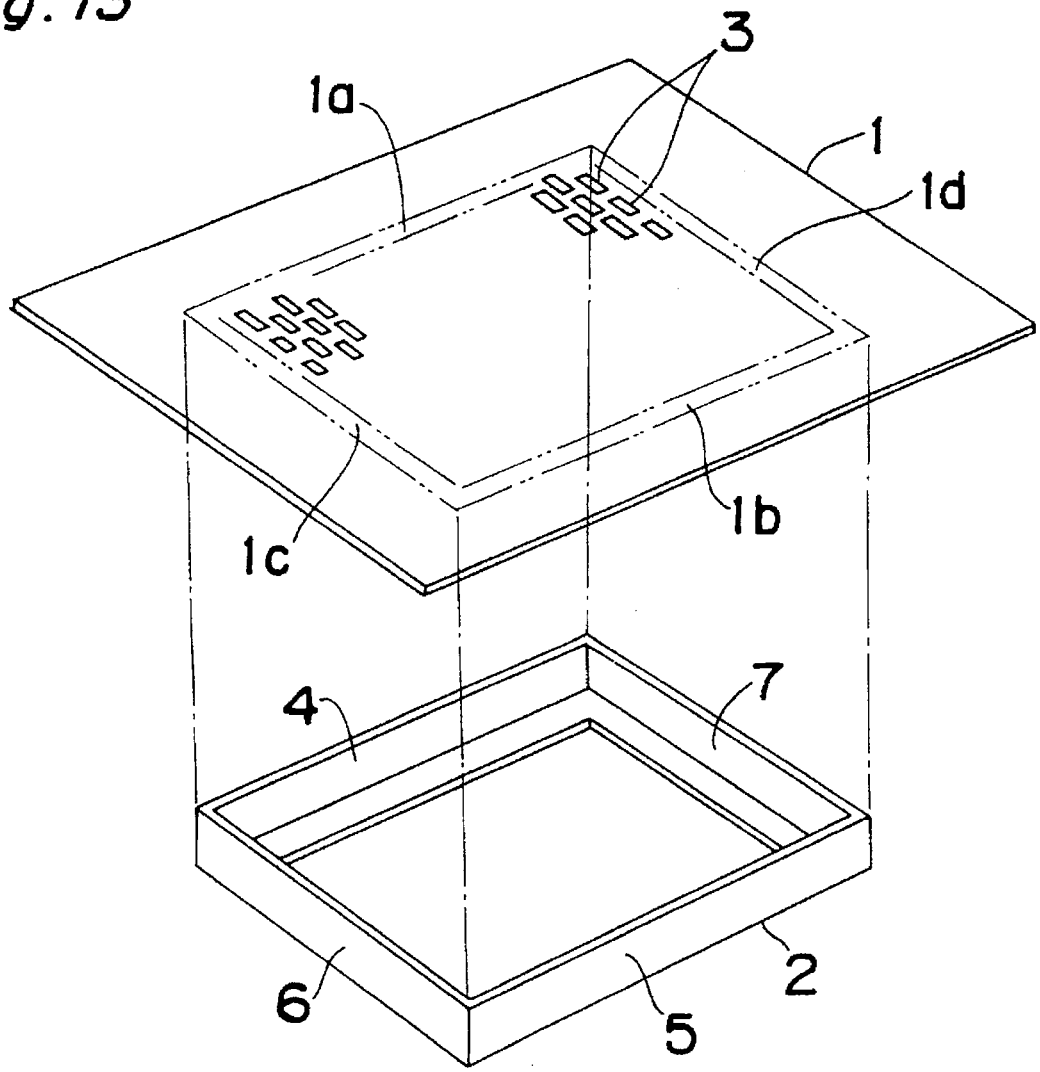
FIG. 13 is an exploded perspective view of a prior art mask type color selecting electrode.
Figure 14A:
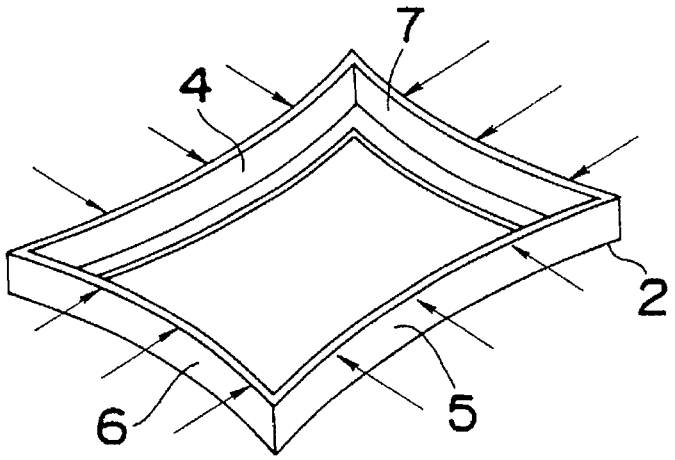
FIGS. 14A, 14B, and 14C are perspective views of an assembling process of the prior art mask type color selecting electrode.
Figure 14B:
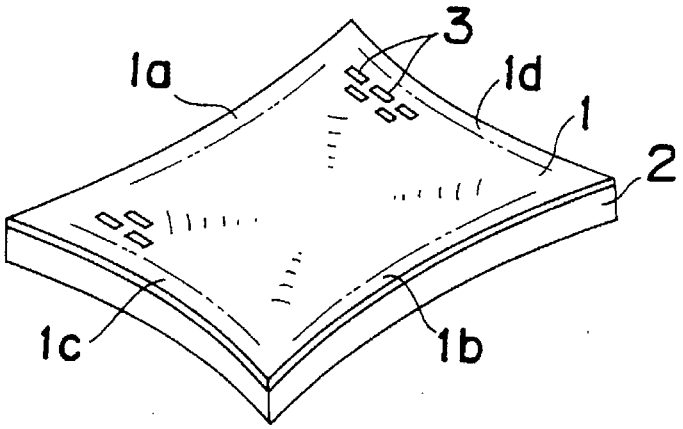
Figure 14C:
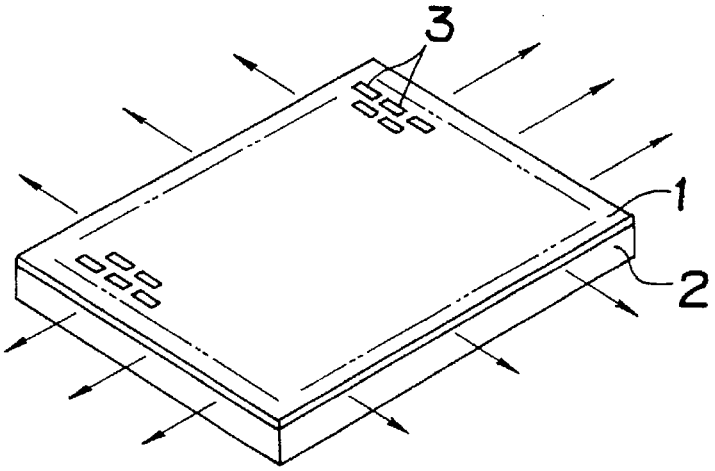

In an embodiment shown in FIGS. 12A through 12D, a hoop member or a plate member 49 as shown in FIG. 12A is bent in the positions of slits 50 in a manner as shown in FIG. 12B, and it is welded in a portion "A" to form a frame body. Then, each bottom end portion 49*a* of the frame body is bent inward in a manner as shown in FIG. 12C to obtain a frame. The slits 50 may have either a U-shaped or a V-shaped planar configuration, and such slits can be formed by passing the frame plate between two rollers provided with a cutter or by means of a slitter. The bottom end portion 49*a* may be bent either at or around a lengthwise end portion of each slit 50. Overlapped portions of the bottom end portions 49*a* in a portion "B" may be welded together in a position as indicated by a reference character X in FIG. 12D.

Each of the color selecting electrodes of the aforementioned embodiments has an aspect ratio of about 3:4. However, in the case of a color selecting electrode having an aspect ratio of 9:16, it is proper to select the section modulus and the rigidity of each of the short sides and the long sides according to the aspect ratio.

According to the present invention, the pair of long sides of the rectangular frame-shaped frame has a greater section modulus and a greater rigidity than the pair of short sides. Therefore, a spring force required for stretching the mask plate uniformly throughout the plate surface can be generated appropriately in the four sides of the frame even when the mask plate is expanded at an elevated temperature.

Furthermore, by forming each of the long sides and the short sides sectionally in an inverted V-shaped configuration in which the top surface is interposed between the outer vertical surface and the inner inclined surface, the inner inclined surface can extend along electron beam paths at a maximum deflection angle, and the outer vertical surface can extend along a glass valve wall of the color-picture tube. With the above-mentioned arrangement, the color selecting electrode can be stably supported inside the glass valve without dimensionally increasing nor complicating the frame and its support mechanism.

Furthermore, by forming each of the long sides sectionally in a trapezoidal configuration having the outer vertical surface, the inner inclined surface, the top surface, and the bottom surface and forming each of the short sides sectionally in a X-shaped configuration or an inverted V-shaped configuration having the inner inclined surface and the top surface, the four sides of the frame can be made to have a rigidity sufficient for stretching the mask plate uniformly throughout the plate surface even with a metal strip having a relatively low height.

Furthermore, by forming each of the long sides sectionally in a δ-shaped configuration having the outer vertical surface, the inner inclined surface, the top surface, and the bottom surface and forming each of the short sides sectionally in a Z-shaped configuration or a δ-shaped configuration having the vertical surface, the top surface and the bottom surface, a desired frame can be formed only by subjecting a single metal plate cut out in a specified configuration to a bending process.

Furthermore, according to the color selecting electrode manufacturing method of the present invention, by welding to a frame, of which four sides are pressed inward, a mask plate of which four sides are stretched outward by a distributed force which approximately counterbalances the applied force of pressure, a contraction force exerted in the mask plate and a resilience force exerted in the frame approximately counterbalance each other when the pressure force and the tension force are released after the welding process. Therefore, the mask plate can be stretched on the frame with a high degree of flatness in the same state as that just before the release of the forces.

According to the present invention as described above, the mask plate can be stably stretched on the top surfaces of the rectangular frame-shaped frame while maintaining a high degree of flatness. Therefore, a color-picture tube having an excellent color reproducibility can be obtained.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A method of manufacturing a color selecting electrode for a color-picture tube comprising: a rectangular frame-shaped frame having a pair of mutually-opposite long sides and a pair of mutually-opposite short sides; and a mask plate welded to top surfaces of the frame, the long sides having a greater section modulus and a greater rigidity than the short sides, the method comprising the step of:

welding, to the frame pressed inward by an equally-distributed force applied to the pair of long sides and the pair of short sides, a mask plate of which four sides are stretched outward by a distributed force which approximately counterbalances the equally distributed force.

2. The method of manufacturing a color selecting electrode for a color-picture tube as claimed in claim 1, wherein the pair of long sides and the pair of short sides are each formed by folding a flat plate.

3. The method of manufacturing a color selecting electrode for a color-picture tube as claimed in claim 2, wherein the flat plate which serves as a frame material has slits at both side portions of a bending line of the flat plate.

* * * * *